United States Patent [19]

Kajikawa et al.

[11] Patent Number: 4,535,519

[45] Date of Patent: Aug. 20, 1985

[54] METHOD OF MANUFACTURING A VALVE SLEEVE

[75] Inventors: Hiromi Kajikawa, Namegawa; Masao Sugita, Higashi-matsuyama, both of Japan

[73] Assignee: Jidosha Kiki Co., Ltd., Tokyo, Japan

[21] Appl. No.: 595,791

[22] Filed: Apr. 2, 1984

[30] Foreign Application Priority Data

Apr. 6, 1983 [JP] Japan ..... 58-60530

[51] Int. Cl.[3] ..... B21D 53/00

[52] U.S. Cl. ..... 26/157.1 R; 29/557; 29/558; 29/DIG. 26; 72/325; 72/348; 72/370; 251/367

[58] Field of Search ..... 29/157.1 R, 557, 558, 29/DIG. 26, DIG. 33, DIG. 41; 72/324, 325, 347, 348, 356, 370; 251/366, 367, 359

[56] References Cited

U.S. PATENT DOCUMENTS

| | | | |
|---|---|---|---|
| 1,714,398 | 5/1929 | O'Bannon | 29/157.1 R X |
| 1,870,970 | 8/1932 | Stevenson | 29/157.1 R |
| 2,027,922 | 1/1936 | McNaught | 72/325 |
| 2,079,513 | 5/1937 | Lapsley | 29/558 UX |
| 3,591,139 | 7/1971 | Bishop | 251/367 |
| 4,103,407 | 8/1978 | Elizalde et al. | 29/157.1 |
| 4,166,373 | 11/1979 | Braun | 72/356 |
| 4,292,831 | 10/1981 | Simon | 72/370 |
| 4,419,877 | 12/1983 | Alfano | 72/325 |
| 4,442,579 | 4/1984 | Millard | 29/157.1 R |

FOREIGN PATENT DOCUMENTS

| | | | |
|---|---|---|---|
| 535072 | 11/1958 | Belgium | 72/356 |
| 2004355 | 11/1969 | France . | |

*Primary Examiner*—Howard N. Goldberg
*Assistant Examiner*—Ronald S. Wallace
*Attorney, Agent, or Firm*—Flynn, Thiel, Boutell & Tanis

[57] ABSTRACT

A method of manufacturing a valve sleeve which is combined with a valve rotor to form a hydraulic rotary valve comprises a first step of expanding one end of a cylindrical member, a second step of forming a plurality of axial grooves in the internal surface of the cylindrical member while leaving its opposite ends intact, and a third step of restoring the expanded portion to its original diameter which it assumes before the expanding step.

11 Claims, 15 Drawing Figures

METHOD OF MANUFACTURING A VALVE SLEEVE

BACKGROUND OF THE INVENTION

The invention relates to a method of manufacturing a valve sleeve which is used to form a hydraulic rotary valve.

A hydraulic rotary valve which may be used in a power steering apparatus, for example, comprises a valve rotor having a plurality of axial grooves formed therein and a valve sleeve rotatably fitted around the periphery of the valve rotor and having an internal surface in which axial grooves are formed which are capable of being brought into overlapping relationship with the opposite circumferential sides of the grooves in the valve rotor. A relative rotational displacement between the valve rotor and sleeve controls the supply and drainage of a hydraulic fluid to or from a power cylinder. Grooves in the valve sleeve are formed as blind grooves, namely, recesses are formed in an intermediate section of the sleeve to define the grooves while the both end sections of the sleeve must be left free from grooves.

A method of forming such a blind groove in the internal surface of a cylindrical valve sleeve is disclosed in U.S. Pat. No. 3,591,139. The disclosed method comprises repeatedly driving a cutter of a given size back and forth through a cylindrical member along an arcuate path to form a single groove, and synchronously rotating the member to form a plurality of grooves in a successive manner. Disadvantageously, this operation requires an equipment of complex construction and an increased length of working time.

SUMMARY OF THE INVENTION

It is therefore an object of the invention to provide a method of manufacturing a valve sleeve which is capable of forming blind grooves in the internal surface of a valve sleeve through simple steps.

It is another object of the invention to provide a method of manufacturing a valve sleeve by which blind grooves can be formed in the internal surface of the sleeve through a simple rectilinear motion of a cutting tool.

It is a further object of the invention to provide a method of manufacturing a valve sleeve by which a plurality of blind grooves can be simultaneously machined in the internal surface of the sleeve.

Other objects, features and advantages of the invention will become apparent from the following description with reference to the drawings.

BRIEF DESCRIPTION OF THE DRAWINGS

FIG. 1 is a longitudinal section of a cylindrical member.

FIGS. 2 and 3 are longitudinal sections showing a first and a second step, respectively, of the method of the invention;

FIGS. 4 and 5 are a front view and a bottom view, respectively of a second punch;

FIGS. 6 and 7 are longitudinal sections showing a third step of the method;

DESCRIPTION OF EMBODIMENTS

Figure 1:
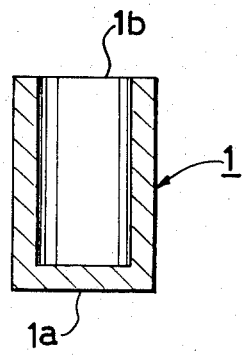
FIGS. 1 to 7 illustrate one embodiment of the invention, and specifically.
Figure 2:
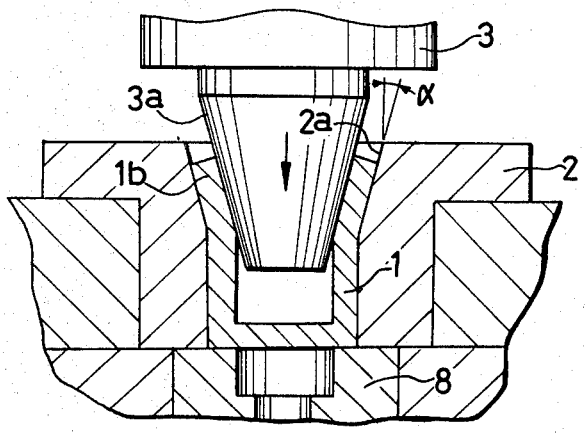

Referring to the drawings, a cylindrical member 1 having a bottom 1*a* as shown in FIG. 1 is formed by a forging or shaving process. The member 1 is then subject to a first press operation, illustrated in FIG. 2, which expand its region of opening 1*b* outwardly. A press die 2 used to carry out in this step is provided with a tapered, upper peripheral surface 2*a* on its interior while a punch 3 associated therewith is frusto-conical in configuration and has an inclined surface 3*a* which is adapted to mate with the tapered surface 2*a* of the press die 2. The member 1 is placed within the press die 2, and the punch 3 is driven or pressed thereagainst, thereby expanding the opening portion 1*b* of the member 1 outwardly.

Figure 3:
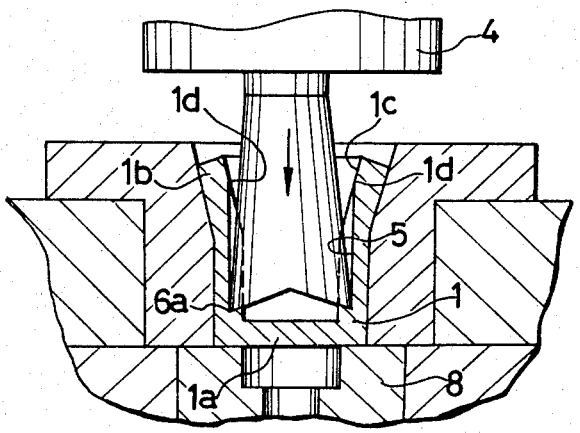
Figure 4:
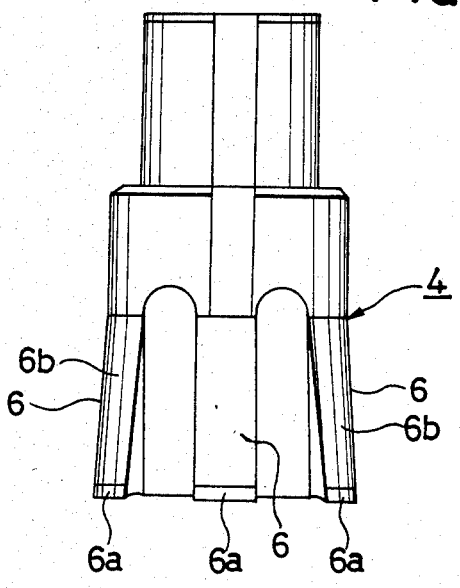
Figure 5:
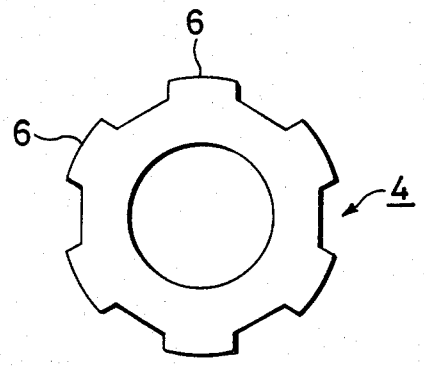

Referring to FIG. 3, a second press operation then takes place using a second punch 4, which forms a plurality of axial grooves 5 in the internal surface of the cylindrical member 1 which has opening portion 1*b* already expanded. As shown in FIGS. 4 and 5, the second punch 4 is formed with a plurality of ribs 6 which are equal in number to the number of axial grooves to be formed in the valve sleeve and which are spaced apart at a substantially, equal interval circumferentially. It will be noted that the ribs 6 exhibit its greatest outward projection at its tip 6*a* which its upper region 6*b* is bevelled inwardly, thus providing a relief area for the press operation. A plurality of grooves 5 are formed simultaneously, using the second punch 4 in the press operation. It should be understood that the press operation may be accomplished in one step to form complete grooves 5 or may be accomplished in a roughing and a finishing step. Since the opening portion 1*b* of the member 1 is expanded radially outward, an interference of the tip 6*a* of the rib on the punch 4 with the internal surface 1*c* of the opening portion adjacent to the edge thereof is avoided, allowing the rib to move a small distance past the opening portion 1*b* to reach an area 1*d* where an initial contact occurs. The punch 4 is subsequently driven toward the bottom 1*a*, thus forming grooves 5 which extend close to the bottom 1*a*, leaving the material of the member 1 adjacent thereto. Thus it will be seen that the amount of material of the member 1 which is expanded outwardly by the first press operation or the angle of inclination ($\alpha$) (see FIG. 2) of the tapered surfaces 2*a*, 3*a* on the press die 2 and the punch 3, respectively, is determined by an angle required to allow the internal surface 1*c* of the member 1 adjacent to its end to be left without working. It should also be noted that other factors such as springback are taken into consideration.

Figure 6:
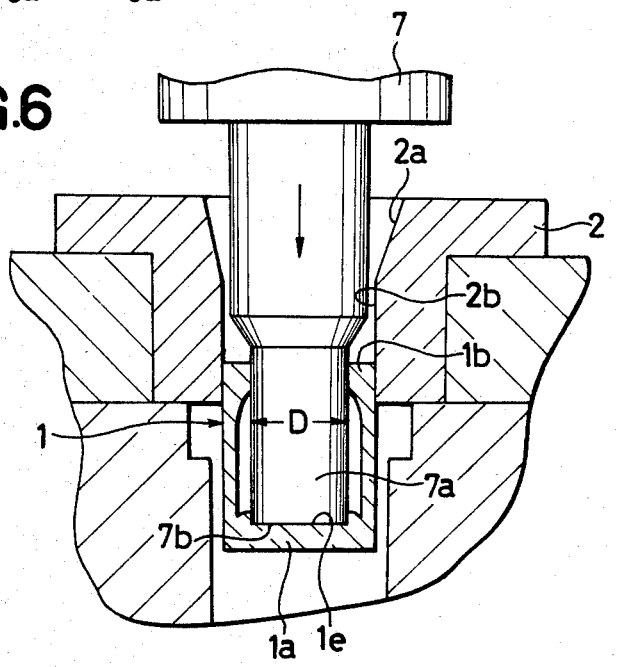
Figure 7:
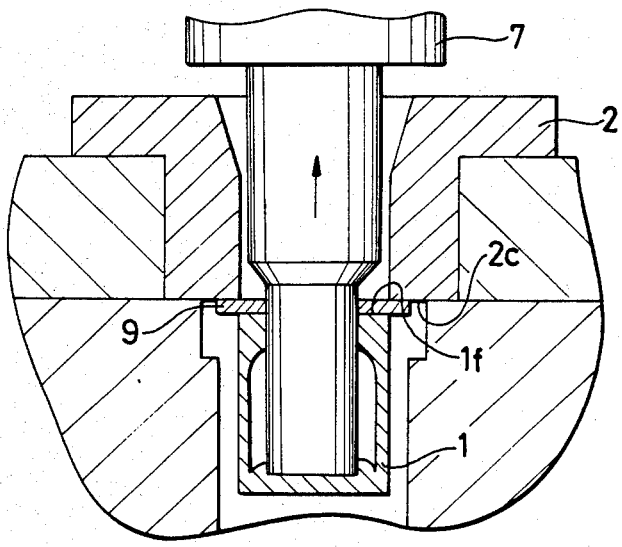

A third step then follows to restore the opening portion 1*b* which is expanded by the first step to its original diameter. This step employs a third punch 7 having a portion 7*a* which has an outer diameter (D) which is substantially equal to the inner diameter of the member 1 before it is expanded and an axial length greater than the distance from an inner bottom surface 1*e* to the edge of the opening portion 1*b* of the member 1 (see FIG. 6). In the third step, a support 8 which has been supporting the bottom 1*a* of the member 1 during the first and second steps is removed, allowing the third punch 7 to force the member 1 down as a result of abutment of a forward end face 7*b* thereof against the bottom 1*a* of the member 1. As a consequence, the expanded portion of the member 1 is formed into a cylindrical portion 2*b* of the press die 2, located below the tapered surface 2*a*, whereby it is restored to its original configuration. Because the outer diameter (D) of the punch 7 is substantially equall to the original inner diameter of the member 1, the punch 7 serves as a guide for the opening portion 1*b* of the member 1, allowing the latter to be exactly restored to its original diameter. Subsequently the punch 7 continues to be driven downward to expel the member 1 out of cylindrical portion 2*b* of the die, whereupon a C-washer 9 is inserted between the bottom surface 2*c* of the die 2 and the top surface 1*f* of the member 1 (see FIG. 7). The punch 7 is then withdrawn from inside the member 1.

The described process of expanding one end of the cylindrical member 1, forming the grooves 5 by a press operation and then restoring the expanded portion to its original diameter allows blind grooves to be machined in the internal surface of the cylindrical member by repeating a simple rectilinear motion, even though the formation of such grooves involved great difficulties in the prior art.

The valve sleeve manufactured according to the method of the invention is substantially the same as conventional one, while not specifically shown, an even number of axial grooves, which are six in number in the described embodiment, but may be four or eight as well, are formed substantially equi-distantly in the inner peripheral surface of the sleeve. It forms a hydraulic rotary valve together with a valve rotor rotatably fitted into the valve sleeve and having a plurality of axial grooves formed therein which overlap the opposite circumferential sides of each groove formed in the sleeve. Where the grooves formed in the valve sleeve are not spaced apart by a uniform distance, it is also possible to construct a hydraulic rotary valve by combining, it with a valve rotor in which grooves are formed in a manner corresponding to those formed in the sleeve.

Figure 8:
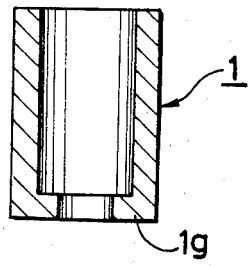
FIG. 8 is a longitudinal section of another form of cylindrical member.
Figure 10:
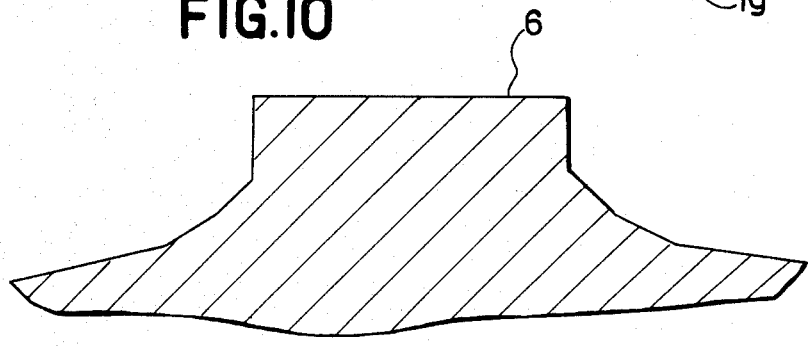
FIG. 10 is a fragmentary bottom view showing another form of punch used in second step.
Figure 9A:
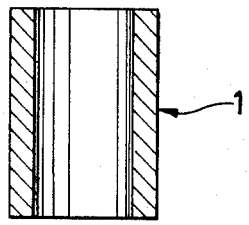
FIGS. 9(*a*), (*b*) and (*c*) are longitudinal sections illustrating another embodiment which utilizes another form of member.
Figure 9B:
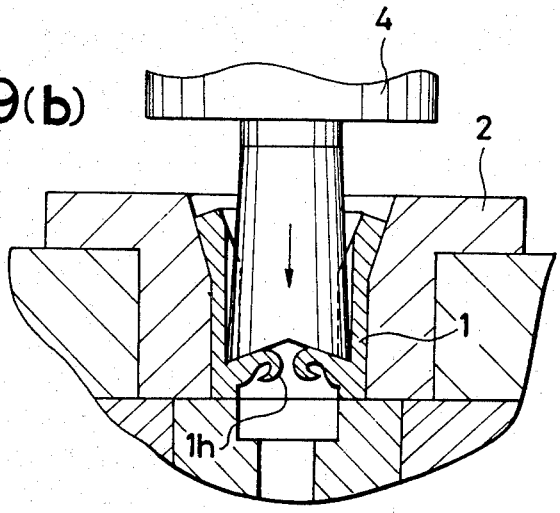
Figure 9C:
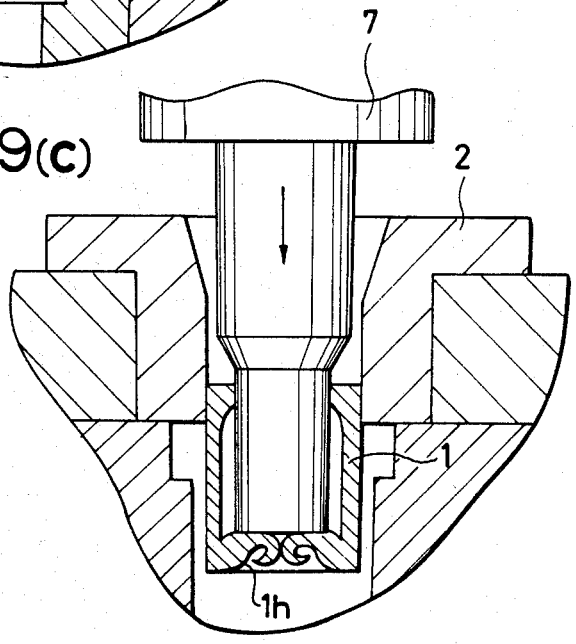

The cylindrical member 1 has a bottom in the described embodiment. However, the presence of the bottom is not essential. By way of example, FIG. 8 shows a cylindrical member having an inward flange 1*g* which can be engaged by the third punch 7. If the member 1 represents a perfect hollow cylinder as shown in FIG. 9*a*, burrs 1*h* formed during the second press step (see FIG. 9*b*) may be engaged by the third punch 7 to force the member 1 through the press die 2, as illustrated in FIG. 9*c*. It will be appreciated that grooves in a hydraulic rotary valve are chamfered to assure a desirable response, but that such chamfering may be achieved concurrently with the formation of the groove by using the second punch 4 having ribs 6 which are shaped as shown in FIG. 10. In this instance, the chamfered portion may be shaped in the form of one or more steps or a curvature form. Furthermore, the chamfered portion may be formed by other processes. It has been described that the third punch 7 has an outer diameter which is substantially equal to the inner diameter of the member 1, where a punch having a reduced diameter is used, it cannot serve as a guide surface when restoring the expanded portion. Nevertheless it is possible to restore the expanded portion to its original diameter. In this instance, it is obvious that C-washer 9 need not be used when withdrawing the punch 7.

While the invention has been described above in connection with several embodiments, it should be understood that other changes, modifications and substitutions will readily occur to those skilled in the art from the disclosure given above without departing from the spirit and scope of the invention defined by the appended claims.

Figure 11A:
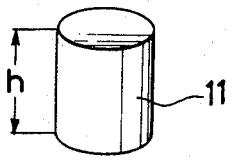
FIGS. 11(*a*), (*b*) and (*c*) illustrate an example showing a step of forming the cylindrical member.
Figure 11B:
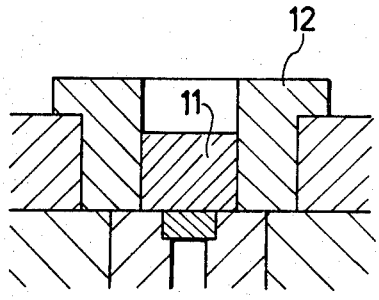
Figure 11C:
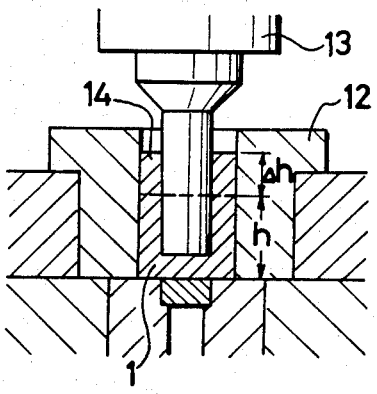

As shown in FIGS. 11(*a*), (*b*) and (*c*), it shows an example that the cylindrical member 1 is formed by a forging process such as cold, hot or warm forging. A rod 11 in FIG. 11(*a*) is placed within a press die 12 as shown in FIG. 11(*b*), and subsequently, a punch 13 which has a given outer diameter is driven or pressed thereagainst (see FIG. 11(*c*)), thereby forming the cylindrical member 1 as shown in FIG. 1. A height (h) of the rod 11 is determined in accordance with a height (Δh) of the portion which is swollen upwardly by the press operation. However, it should also be noted that the above-mentioned method of manufacturing the cylindrical member 1 is not essential and other means such as mechanical working are taken into consideration.

What is claimed is:

1. A method of manufacturing a valve sleeve, comprising a first step of expanding one end of a cylindrical member hollow, a second step of forming a plurality of axial grooves in the internal surface of the cylindrical member leaving the opposite ends thereof intact, and a third step of restoring the expanded portion to its original diameter which it assumes before the expanding step.

2. A method of manufacturing a valve sleeve according to claim 1 in which the first step is carried out by a press operation which utilizes a press die having an upper inner peripheral surface tapered to present an increasing diameter toward the upside and a punch having a tapered surface which mates with the tapered surface of the press die.

3. A method of manufacturing a valve sleeve according to claim 1 in which the second step is carried out by a press operation which utilizes a punch having a rib that is the substantially same width as the axial groove to be formed, the punch being driven into the member through the expanded portion.

4. A method of manufacturing a valve sleeve according to claim 3 in which an interference of the ribs of the punch with the internal surface of the cylindrical member at its end of the expanded portion is avoided during the press operation.

5. A method of manufacturing a valve sleeve according to claim 3 in which a plurality of axial grooves are formed simultaneously by using a punch having ribs which are equal in number to the number of axial grooves.

6. A method of manufacturing a valve sleeve according to claim 5 in which the second step comprises a single pressing step.

7. A method of manufacturing a valve sleeve according to claim 5 in which the second step comprises a plurality of roughing and finishing press operations.

8. A method of manufacturing a valve sleeve according to claim 3 in which the both sidewalls of each groove are chamfered at the same time as the axial grooves are formed.

9. A method of manufacturing a valve sleeve according to claim 1 in which the third step comprises pressing the expanded portion of the cylindrical member into an opening of a press die which has an inner diameter substantially equal to the outer diameter of the cylindrical member which it assumes before the expanding step.

10. A method of manufacturing a valve sleeve according to claim 9 in which the cylindrical member is pressed into the opening of the press die by having the front end of the punch engaged with an inward projection of the cylindrical member which is formed at the end of the latter opposite from the expanded portion.

11. A method of manufacturing a valve sleeve according to claim 10 in which the punch used to press the cylindrical member into the opening has an outer diameter substantially equal to the inner diameter of the cylindrical member which it assumes before the expanding step.

* * * * *

UNITED STATES PATENT AND TRADEMARK OFFICE

CERTIFICATE OF CORRECTION

PATENT NO. : 4 535 519

DATED : August 20, 1985

INVENTOR(S) : Hiromi Kajikawa et al

It is certified that error appears in the above-identified patent and that said Letters Patent is hereby corrected as shown below:

Column 4, line 26; before "cylindrical" insert ---hollow---.
line 27; delete "hollow".

Signed and Sealed this

*Twenty-eighth* Day of *January 1986*

[SEAL]

*Attest:*

DONALD J. QUIGG

*Attesting Officer*

*Commissioner of Patents and Trademarks*